US007819699B2

(12) United States Patent
Xu et al.

(10) Patent No.: US 7,819,699 B2
(45) Date of Patent: Oct. 26, 2010

(54) ELECTRICAL CONNECTOR ASSEMBLY HAVING IMPROVED SUBSTRATE

(75) Inventors: Yong-Chun Xu, Kunshan (CN); Hong-Bo Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/506,447

(22) Filed: Jul. 21, 2009

(65) Prior Publication Data

US 2010/0015852 A1 Jan. 21, 2010

(30) Foreign Application Priority Data

Jul. 21, 2008 (CN) ..... 200820041960.2

(51) Int. Cl.
*H01R 13/66* (2006.01)

(52) U.S. Cl. ..... 439/620.09

(58) Field of Classification Search ..... 439/620.09, 439/620.06, 629.15, 676, 541.5, 941, 76.1
See application file for complete search history.

(56) References Cited

U.S. PATENT DOCUMENTS 6,171,152 B1 * 1/2001 Kunz ..... 439/620.18
6,193,560 B1 * 2/2001 Morana et al. ..... 439/676
6,537,110 B1 * 3/2003 Korsunsky et al. ..... 439/676
6,585,540 B2 * 7/2003 Gutierrez et al. ..... 439/620.19
6,761,595 B1 * 7/2004 Zheng et al. ..... 439/676
6,786,772 B1 * 9/2004 Liu ..... 439/620.06
6,962,511 B2 * 11/2005 Gutierrez et al. ..... 439/676
7,241,181 B2 * 7/2007 Machado et al. ..... 439/676
7,367,851 B2 5/2008 Pulse

* cited by examiner

*Primary Examiner*—Jean F Duverne
(74) *Attorney, Agent, or Firm*—Ming Chieh Chang; Wei Te Chung; Andrew C. Cheng

(57) ABSTRACT

An electrical connector assembly has an insulative housing (2) defining a number of receiving spaces (24) and a number of contact modules (4) inserted in the receiving spaces. Each contact module comprises a first substrate (41) having a pair of substrate halves (411), and a pair of conductive units respectively mounted on corresponding substrate halves. The first substrate has a number of circuit traces formed thereon and one electronic component (415) disposed on one substrate half. The circuit traces is electrically connected with the pair of conductive units and the electronic component. The pair of conductive units share the electronic component commonly via the circuit traces.

9 Claims, 4 Drawing Sheets

ELECTRICAL CONNECTOR ASSEMBLY HAVING IMPROVED SUBSTRATE

BACKGROUND OF THE INVENTION

1. Field of the Invention

The present invention relates in general to a multi-port electrical connector assembly, and more particularly to a stacked modular jack having an improved substrate to allow two conductive units sharing one capacitor.

2. Description of Related Arts

U.S. Pat. No. 7,367,851, issued on May 6, 2008 and entitled with "Universal Connector Assembly and Method of Manufacturing", discloses a multi-port electrical connector assembly. The electrical connector assembly includes a multi-port insulative housing, and a number of contact modules received in the insulating housing from the rear portion. Each contact module includes a substrate, and a plurality of electronic components including resistors and capacitor. It would result in high cost, since each substrate is adapted for mounting one capacitor.

Hence, it is desirable to provide a multi-port electrical connector assembly having less resistors or capacitors or other components to reduce the cost.

SUMMARY OF THE INVENTION

An object of the present invention is to provide a multi-port electrical connector assembly having less capacitor to reduce the cost of the connector assembly.

To achieve the above object, at electrical connector assembly comprises an insulative housing defining a plurality of receiving spaces and a plurality of contact modules inserted in the receiving spaces. Each contact module comprises a first substrate having a pair of substrate halves, and a pair of conductive units respectively mounted on corresponding substrate halves. The first substrate has a plurality of circuit traces formed thereon and one electronic component disposed on one substrate half. The circuit traces is electrically connected with the pair of conductive units and the electronic component. The pair of conductive units share the electronic component commonly via the circuit traces.

The first substrate comprises a pair of interconnected substrate halves. The first substrate has a plurality of circuit traces disposed thereon and one electronic component disposed on one substrate half. Thus, two adjacent conductive units could share one electronic component via the circuit traces. As a result, the electronic components used by the conductive units could be formed into a fewer number. The cost of manufacturing the electrical connector assembly has been reduced.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Reference will now be made in detail to a preferred embodiment of the present invention.

Figure 1:
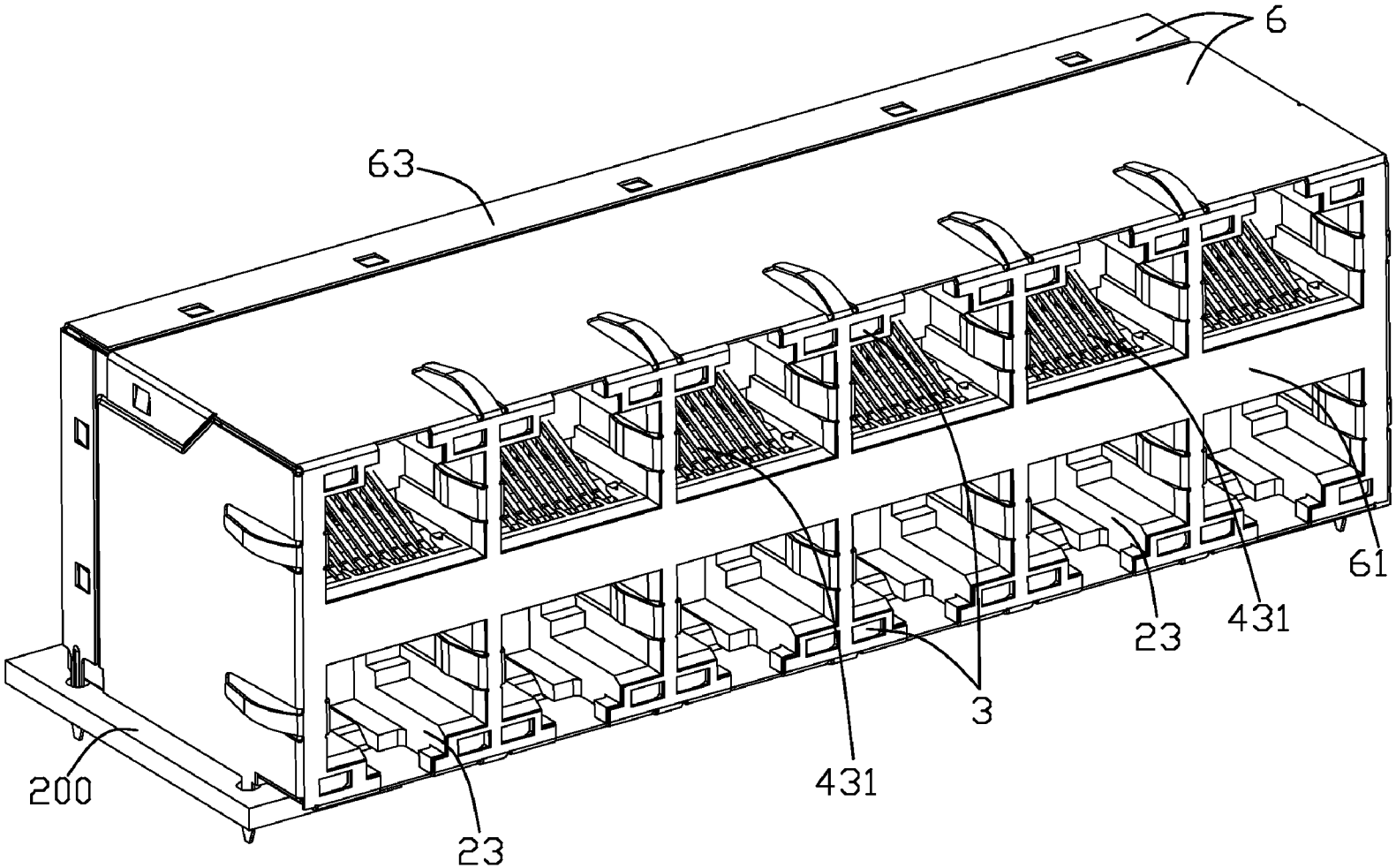
FIG. 1 is a perspective view of an electrical connector assembly of the present invention mounted on a printed circuit board.
Figure 2:
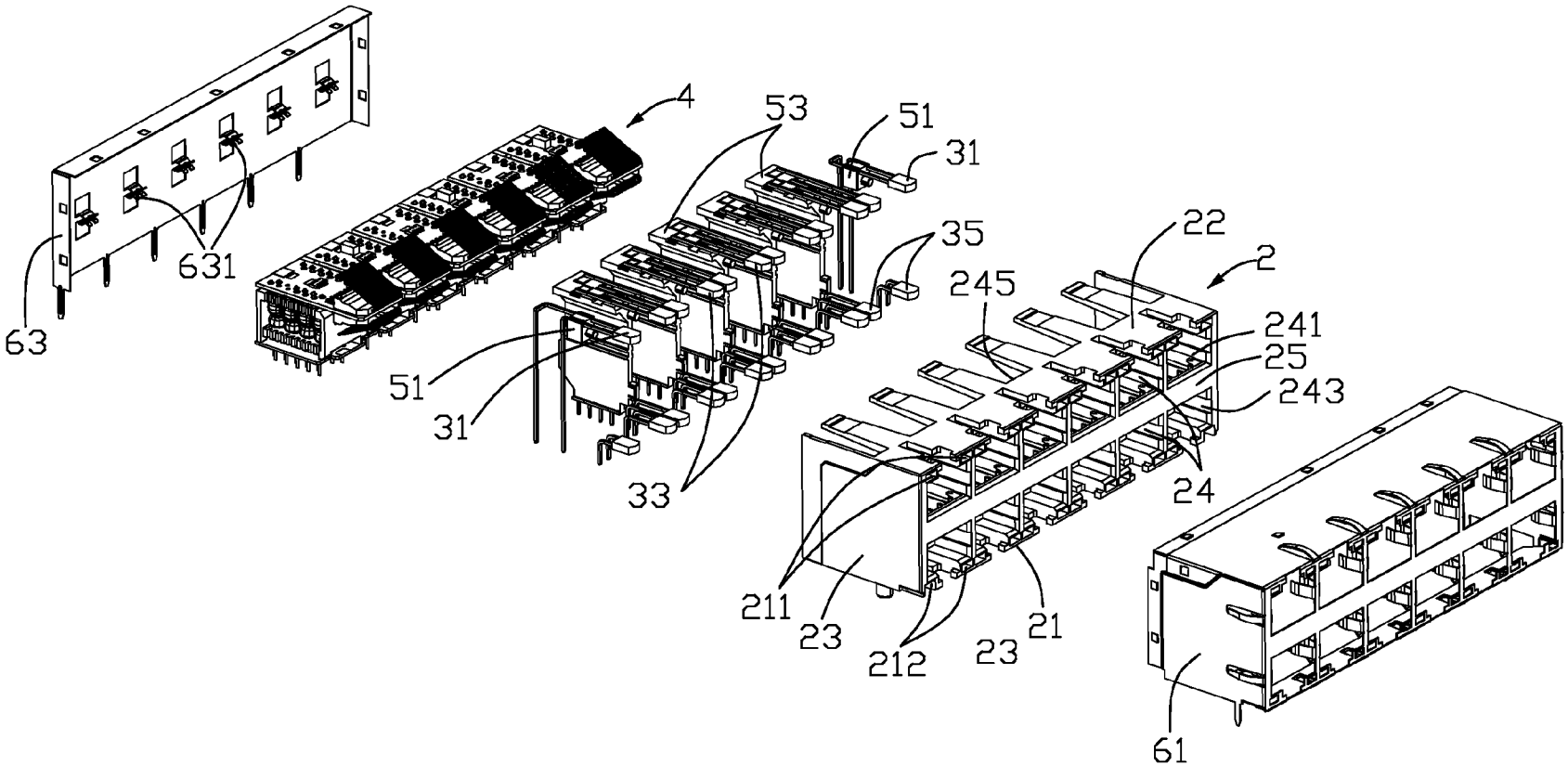
FIG. 2 is an exploded perspective view of the electrical connector assembly as shown in FIG. 1.

Referring to FIGS. 1 and 2, an multi-port electrical connector assembly 100 in accordance with a preferred embodiment of the present invention is mounted on a printed circuit board 200. The multi-port electrical connector assembly 100 is used in date networking applications. The electrical connector assembly 100 generally comprises an insulative housing 2, a plurality of contact modules 4 received in the insulative housing 2, a plurality of indicator devices 3 for indicating the working status of the connector assembly 100, and a shielding member 6 enclosing the insulative housing 2.

The insulative housing 2 comprises a bottom wall 21, a top wall 22 opposite to the bottom wall 21, a pair of periphery walls 23 perpendicular to the bottom wall 21, and a plurality of mating ports 24 defined above the bottom wall 21. The mating ports 24 further include a plurality of first mating ports 241 and a plurality of second mating ports 243 below the first mating ports 241. Each first mating port 241 and each second mating port 243 define a pair of receiving rooms 245. The insulative housing 2 further has a front face 25, a rear face (not shown) opposite to the front face 25. The insulative housing 2 has a pair of first recesses 211 respectively disposed above the first mating port 24, a pair of second recesses 212 respectively disposed below the second mating port 24.

Figure 3:
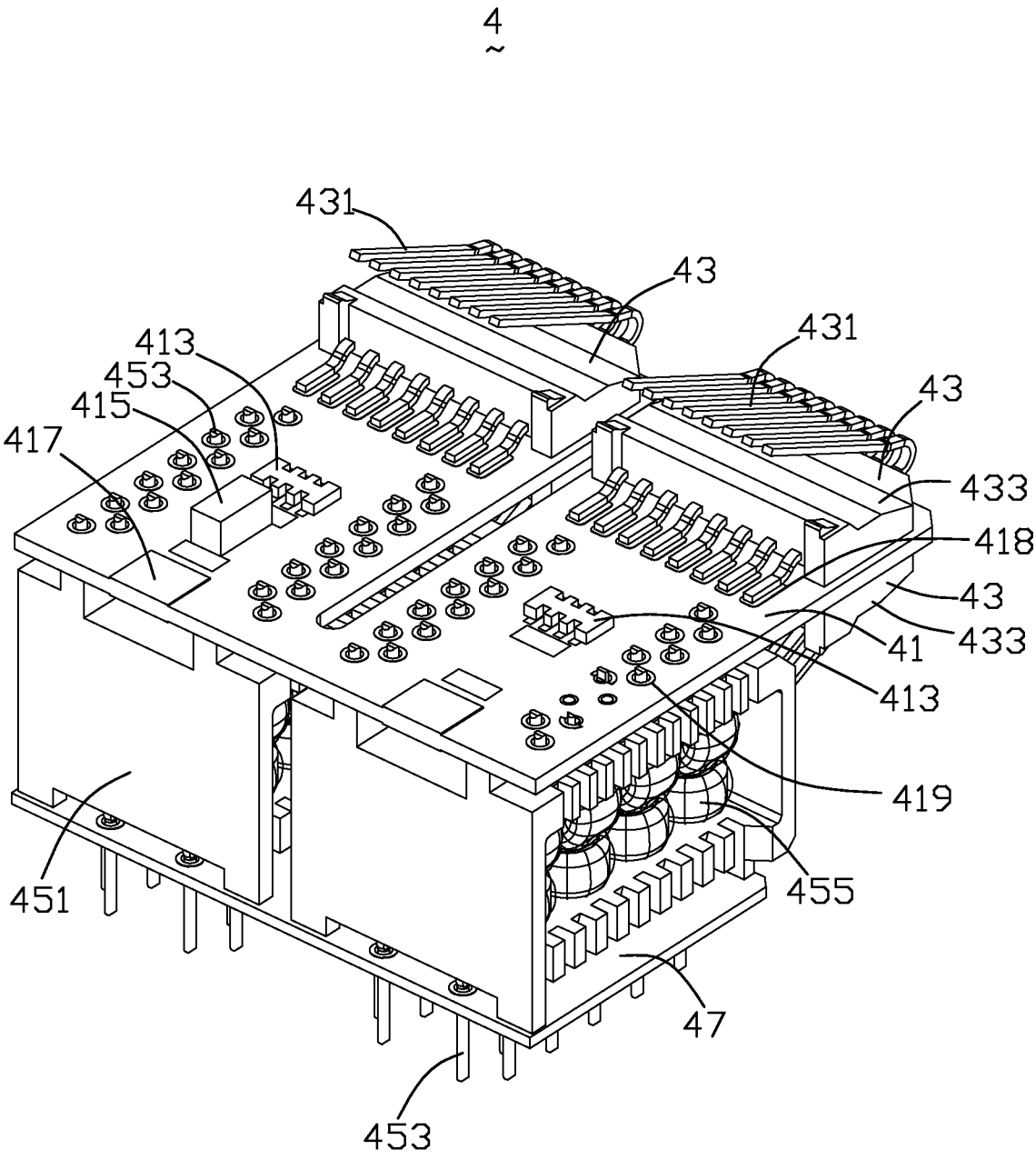
FIG. 3 is an perspective view of a contact module of the electrical connector assembly as shown in FIG. 2.
Figure 4:
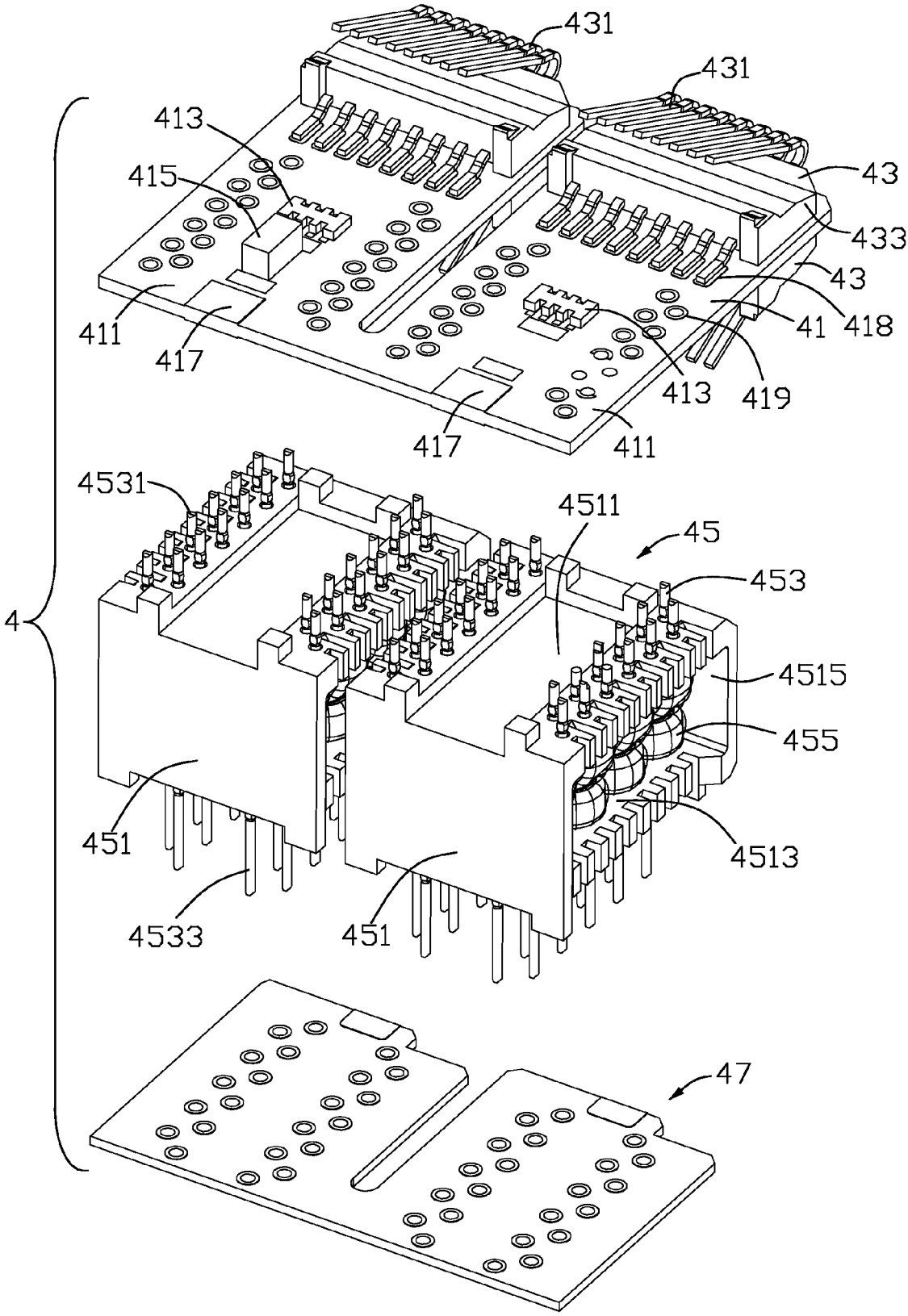
FIG. 4 is an exploded view of the contact module as shown in FIG. 3.

Referring to FIGS. 3 and 4, each contact module 4 is received in the receiving room 241. Each contact module 4 comprises a substrate 41 parallel to the printed circuit board 200, two pairs of terminal groups 43 mounted on the opposite sides of the substrate 41 and a bottom substrate 47 mounted under the filter modules 45. The substrate 41 has a plurality of resistors 413 and one capacitor 415 disposed thereon.

Each substrate 41 includes a pair of substrate halves 411 corresponding to two pairs of receiving rooms 245. Each substrate halves 411 has a grounding pad 417, a row of first conductive pads 418, a plurality of second conductive pads (not label), a plurality of conductive holes 419, and a plurality of conductive traces (not shown) connecting to the first conductive pads 418 and the conductive holes 419. The resistors 413 are mounted on the second conductor pads of each substrate half 411. The capacitor 415 is mounted on one substrate half 411. The circuit traces (not shown) of the two substrate halves 411 are interconnected with each other.

A pair of terminal groups 43 are mounted on opposite sides of each substrate half 411 of the substrate 41. Each terminal group 43 has a shelf 433 and a plurality of terminals 431 mounted on the shelf 433. The terminals 431 are soldered on the first conductive pads 418 of substrate 41 by SMT (Surface Mount Technology) for mating with the terminals of the mating connector (not shown) to transmit signals.

The filter module 45 includes a base 451, a plurality of converting terminals 453 and a plurality of the filter coils 455. The base 451 has an upper wall 4511 and a bottom wall 4513 opposite to the upper wall 4511, and a cavity 4515 defined between the upper wall 4511 and the bottom wall 4513. The filter coils 455 are received in the cavity 4515. The converting terminals 453 include first converting terminals 4531 and second converting terminals 4533. The first converting terminals 4531 are mounted on the upper wall 4511, with one end inserted through the conductive holes 419 of the substrate 41 and another end connected to one tip end of the filter coil 455. The second converting terminals 4533 has one end mounted on the bottom substrate 47, and another end connected to another tip end of the filter coil 455. The pair of terminal groups 43 and a filter module 45 could be regarded into a conductive unit. The first substrate comprises a pair of interconnected substrate halves.

The substrate 41 has a plurality of circuit traces disposed thereon and one capacitor 415 disposed on one substrate half 411. Thus, two adjacent conductive units could share one capacitor 415 via the circuit traces. As a result, the capacitor 415 used by the conductive units could be formed into a fewer number. The cost of manufacturing the electrical connector assembly 100 has been reduced.

Referring to FIGS. 1 and 2, the indicator device 3 includes a pair of first base sections 51, a pair of first indicator 31 fixed on the first base sections 51, a plurality of second base sections 53, a plurality of second indicators 33 fixed on the second base section 53, and a plurality of third indicators 35. The first indicators 31 are received in the first recesses 211 which near the periphery walls 23. The second base sections 53 are mounted on the rear portion of the insulative housing 2. The second indicators 33 are arranged between the first indicators 31. The third indicators 35 are received in the second recess 212.

Referring to FIGS. 1 and 2, the shielding member 6 includes a front shielding 61 and a rear shielding 63 coupling with the front shielding 61. The front shielding 61 and rear shielding 63 enclose the insulative housing 2 from the front face 25 and rear face (not shown) respectively. The rear shielding 63 has a plurality of holding pieces 631. The grounding pads 417 are partially soldered to corresponding holding pieces 631 for grounding. The soldered grounding pads 417 and the unsoldered grounding pads 417 are arranged alternately. Optionally, all of the grounding pads 417 could be soldered to all of the holding pieces 631.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing defining a plurality of receiving spaces;

a plurality of contact modules inserted in the receiving spaces, each contact module comprising a first substrate having a pair of substrate halves, and a pair of conductive units respectively mounted on corresponding substrate halves, said first substrate having a plurality of circuit traces formed thereon and one electronic component disposed on one substrate half, the circuit traces being electrically connected with the pair of conductive units and the electronic component, said pair of conductive units sharing the electronic component commonly via the circuit traces; wherein each conductive unit comprises a pair of terminal groups respectively mounted on opposite sides of the substrate half and received in corresponding receiving spaces; wherein said substrate half is formed with a plurality of conductive pads, and wherein each terminal group comprises a shelf mounted on the substrate half, and a plurality of terminals assembled to the shelf and electrically connected to the conductive pads of the substrate half; wherein said terminals are soldered on the conductive pads of the substrate half by surface mount technology; wherein each conductive unit comprises a filter module comprising a second substrate and a plurality of converting terminals electrically connected with the first substrate and the second substrate; wherein each substrate half defines a plurality of conductive holes for insertion of the converting terminals; wherein said filter module comprises a base, a plurality of filter coils received in a the base, and wherein said converting terminals comprise a plurality of first converting terminals each electrically connected with the conductive holes of the first substrate and one tip end of the filter coil and, and a plurality of second converting terminals each electrically connected with the second substrate and another tip end of the filter coil.

2. The electrical connector assembly as claimed in claim 1, wherein said electronic component is a capacitor.

3. The electrical connector assembly as claimed in claim 1, wherein said circuit traces electrically connect with the conductive pads, the conductive holes and the electronic component.

4. The electrical connector assembly as claimed in claim 3, wherein said first substrate has a plurality of electrical components mounted thereon and electrically connected with the circuit traces.

5. The electrical connector assembly as claimed in claim 1, further comprising a shielding member attached to the insulative housing for shielding.

6. The electrical connector assembly as claimed in claim 5, wherein said shielding member is formed with a plurality of holding pieces, and wherein each substrate half has a grounding pad, at least some of grounding pads being soldered to corresponding holding pieces for grounding.

7. The electrical connector assembly as claimed in claim 6, wherein soldered grounding pads and unsoldered grounding pads are arranged alternately.

8. The electrical connector assembly as claimed in claim 1, further comprising a plurality of indicator devices, and wherein the insulative housing has a pair of recesses defined in each receiving space for receiving the indicator device.

9. An electrical connector assembly comprising:

an insulative housing defining a plurality of receiving cavities;

an upper substrate defining opposite upper and lower surfaces;

at least a pair of terminal modules mounted upon the upper face and extending into the corresponding receiving cavities, respectively;

at least a pair of filter modules mounted upon the lower face; and a lower substrate located under the filter module and cooperating with the upper substrate to sandwich the pair of filter modules therebetween; wherein only one capacitor is mounted on the upper substrate and is shared by both said pair of terminal modules via traces on the upper substrate.

* * * * *